US010201208B1

(12) United States Patent
Bochner

(10) Patent No.: US 10,201,208 B1
(45) Date of Patent: Feb. 12, 2019

(54) FOLDABLE HELMET

(71) Applicant: Ronnie Z. Bochner, New York, NY (US)

(72) Inventor: Ronnie Z. Bochner, New York, NY (US)

( * ) Notice: Subject to any disclaimer, the term of this patent is extended or adjusted under 35 U.S.C. 154(b) by 0 days.

(21) Appl. No.: 15/659,795

(22) Filed: Jul. 26, 2017

(51) Int. Cl.

| | |
|---|---|
| ***A42B 3/32*** | (2006.01) |
| ***A63B 71/10*** | (2006.01) |
| ***A42B 3/00*** | (2006.01) |
| ***B65D 85/18*** | (2006.01) |

(52) U.S. Cl.
CPC ..... *A42B 3/322* (2013.01); *A42B 3/006* (2013.01); *A63B 71/10* (2013.01); *B65D 85/18* (2013.01)

(58) Field of Classification Search
CPC ..... A42B 3/006; A42B 3/066; A42B 3/32; A42B 3/322; A63B 71/10; B65D 85/18
USPC ..... 2/410, 411, 425
See application file for complete search history.

(56) References Cited

U.S. PATENT DOCUMENTS

| | | | | | |
|---|---|---|---|---|---|
| 1,364,662 | A | * | 1/1921 | Wagner | A42B 1/067 2/172 |
| 3,023,134 | A | * | 2/1962 | Cresswell | A42C 2/00 156/296 |
| 3,197,784 | A | * | 8/1965 | Carlisle | A42B 3/00 2/420 |
| 3,353,188 | A | | 11/1967 | Crincic | |
| 3,440,660 | A | * | 4/1969 | Krinke | A42B 1/08 2/172 |
| 3,495,272 | A | | 2/1970 | Tempelhof | |
| 3,514,787 | A | | 6/1970 | Kennedy, Jr. | |
| 3,991,422 | A | | 11/1976 | Saotome | |
| 4,443,891 | A | * | 4/1984 | Blomgren | A42B 3/00 2/414 |
| 4,607,397 | A | | 8/1986 | Laxo | |
| 4,827,537 | A | * | 5/1989 | Villa | A42B 3/322 2/410 |
| 4,856,119 | A | * | 8/1989 | Haberle | A42B 3/08 2/417 |
| 5,012,533 | A | * | 5/1991 | Raffler | A42B 3/066 2/420 |
| 5,173,970 | A | * | 12/1992 | Shifrin | A42B 1/08 2/209.12 |

(Continued)

FOREIGN PATENT DOCUMENTS

| | | |
|---|---|---|
| CN | 203378603 U | 1/2014 |
| CN | 205143616 U | 4/2016 |

(Continued)

*Primary Examiner* — Katherine Moran
(74) *Attorney, Agent, or Firm* — Greenberg Traurig, LLP

(57) ABSTRACT

A foldable helmet for use in various athletic activities, and which includes a structure that facilitates folding the helmet into a compact position for storage and/or transport of same. The helmet includes an outer shell having an inner cavity, and one or more inner members positioned within the inner cavity that slideably engage same. The inner members are not fixedly attached to each other at any point, and are therefore slideable relative to each other. The helmet's inner member(s) and outer shell are made of flexible materials, whereby the helmet is foldable from an open position to a closed position. A packaged helmet assembly is also disclosed, including the foldable helmet and a storage container dimensioned so as to receive the helmet in its closed position.

12 Claims, 5 Drawing Sheets

(56) References Cited

U.S. PATENT DOCUMENTS 5,272,773 A * 12/1993 Kamata ..... A42B 3/066 2/421
5,365,607 A * 11/1994 Benevento, Jr. ..... A42B 1/008 2/171.1
RE35,193 E * 4/1996 Shifrin ..... A42B 1/08 2/209.12
5,515,546 A * 5/1996 Shifrin ..... A42B 3/00 2/209.11
5,544,367 A * 8/1996 March, II ..... A42B 3/00 2/410
5,628,071 A 5/1997 Nezer
5,661,854 A * 9/1997 March, II ..... A42B 3/00 2/410
5,729,830 A * 3/1998 Luhtala ..... A42B 1/066 2/195.1
5,745,923 A * 5/1998 Katz ..... A42B 3/00 2/411
5,887,289 A * 3/1999 Theoret ..... A42B 1/08 2/195.1
5,896,587 A * 4/1999 Gentry ..... A42B 3/061 2/12
5,896,590 A * 4/1999 Fleisch ..... A42B 3/322 2/410
6,397,399 B1 * 6/2002 Lampe ..... A42B 1/008 2/171.2
6,442,765 B1 * 9/2002 Fallon ..... A42B 3/066 2/410
6,904,617 B2 * 6/2005 Tsai ..... A41D 13/0053 2/209.13
7,010,814 B2 3/2006 Benziger
7,043,761 B2 * 5/2006 Epling ..... A42B 1/069 2/181
7,937,778 B1 * 5/2011 Norton ..... A42B 1/08 2/175.4
7,958,572 B2 * 6/2011 Loury ..... A42B 3/322 2/410
8,262,601 B2 * 9/2012 Cumming ..... A61F 13/12 2/171
8,613,114 B1 * 12/2013 Olivares Velasco ... A42B 3/125 2/171
8,713,717 B2 * 5/2014 Cleva ..... A42B 3/04 2/171
8,739,316 B1 * 6/2014 Norton ..... A42B 1/08 2/411
8,789,212 B2 * 7/2014 Cleva ..... A42B 3/04 2/171
8,850,622 B2 * 10/2014 Finiel ..... A42B 3/125 2/410
8,978,167 B2 * 3/2015 Blair ..... A42B 1/08 2/410
9,554,611 B2 1/2017 Arrouart
9,693,594 B1 * 7/2017 Castro ..... A42B 1/08
2002/0023291 A1 * 2/2002 Mendoza ..... A42B 3/064 2/412
2004/0163162 A1 * 8/2004 Benziger ..... A42B 1/08 2/411
2004/0250340 A1 * 12/2004 Piper ..... A42B 3/064 2/411
2004/0255369 A1 * 12/2004 Puchalski ..... A42B 3/06 2/410
2005/0028253 A1 2/2005 Fowler
2005/0246824 A1 * 11/2005 Berger ..... A42B 3/124 2/412
2005/0257312 A1 * 11/2005 Puchalski ..... A42B 3/064 2/411
2006/0059606 A1 * 3/2006 Ferrara ..... A01N 25/18 2/412
2006/0085881 A1 * 4/2006 Gellis ..... A41D 13/11 2/9
2007/0157370 A1 * 7/2007 Joubert Des Ouches ..... A42B 3/06 2/410
2009/0222975 A1 * 9/2009 Green ..... A42B 1/08 2/410
2010/0031426 A1 2/2010 Lapham
2012/0066820 A1 * 3/2012 Fresco ..... A41D 13/0153 2/463
2013/0061373 A1 * 3/2013 Cleva ..... A42B 1/08 2/413
2013/0097767 A1 * 4/2013 Cleva ..... A42B 1/08 2/413
2013/0152274 A1 * 6/2013 Welch ..... A42B 1/008 2/171.2
2013/0191972 A1 8/2013 Woolf
2013/0289459 A1 10/2013 Bernardoni
2013/0318690 A1 * 12/2013 Cleva ..... A42B 3/125 2/411
2014/0207657 A1 7/2014 Gacs
2014/0223641 A1 * 8/2014 Henderson ..... A42B 3/065 2/411
2014/0237706 A1 * 8/2014 O'Conner ..... A42B 1/08 2/410
2015/0089725 A1 4/2015 Lowe et al.
2015/0305423 A1 * 10/2015 Pusateri ..... A42B 1/069 2/2.5
2016/0157548 A1 * 6/2016 Copeland ..... A42B 1/02 2/425
2017/0251747 A1 * 9/2017 Pippin ..... A42B 3/0433
2018/0049508 A1 * 2/2018 Terry ..... A42B 3/322

FOREIGN PATENT DOCUMENTS

GB 2527173 A * 12/2015 ..... A42B 3/32
JP 2005232663 A 9/2005
JP 2010185147 A 8/2010

* cited by examiner

FOLDABLE HELMET

TECHNICAL FIELD OF THE INVENTION

The present invention relates to protective headwear and, more particularly, to a helmet that is foldable and a method relating thereto.

BACKGROUND ART

Helmets are used to protect against head trauma and injuries in many athletic activities. At least some of the people who engage in such activities seek such protection, but also prefer that the helmet is compact and easy to store and carry. As such a foldable helmet is desirable.

SUMMARY OF THE INVENTION

The present invention provides a new and improved foldable helmet for use in various athletic activities, and which includes a structure that facilitates folding the helmet into a compact position for storage and/or transport of same.

The helmet of the present invention includes an outer shell having an inner cavity, a first inner surface and a first outer surface. The helmet further includes at least one inner member positioned within the inner cavity and including a second inner surface and a second outer surface that slideably engages the first inner surface of the outer shell. The helmet may include more than one inner member, i.e., a first inner member having the second inner surface and second outer surface and a second inner member having a third inner surface and a third outer surface, wherein the first inner member is adapted to receive the second inner member therein, such that the second inner surface slideably engages the third outer surface. Additional inner members may also be included.

The first and second inner members of the helmet are not fixedly attached to each other at any point on the second inner surface and third outer surface, whereby the first and second inner members are slideable relative to each other. The helmet's inner member(s) and outer shell are made of flexible materials, whereby the helmet is foldable from an open position to a closed position.

The present invention also includes a packaged helmet assembly, including the foldable helmet and a storage container dimensioned so as to receive the helmet in its closed position.

BRIEF DESCRIPTION OF THE DRAWINGS

In the drawing figures, which are not to scale, and where like reference numerals indicate like elements throughout the several views.

DETAILED DESCRIPTION OF THE INVENTION

Figure 1:
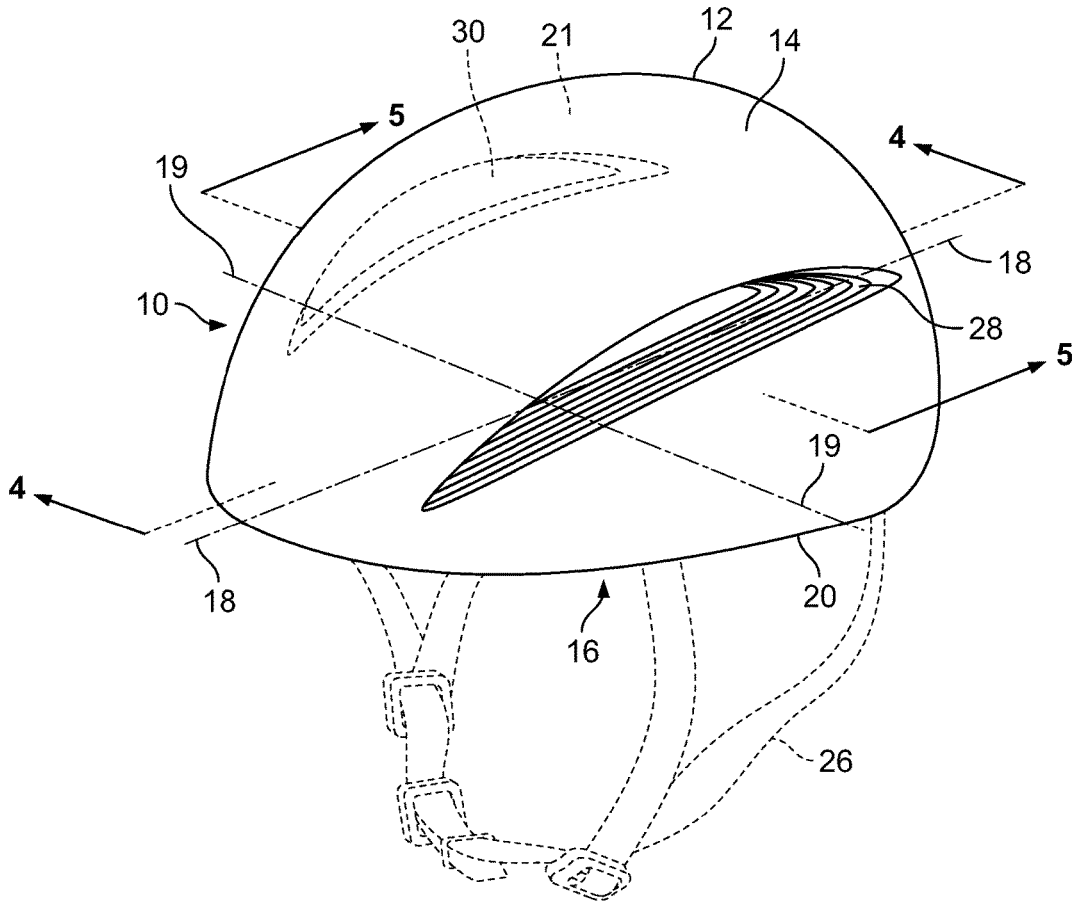
FIG. 1 is a top perspective view of a helmet constructed in accordance with an embodiment of the present invention, in its fully open (i.e., unfolded) position.

Various embodiments are disclosed herein; however, it is to be understood that the disclosed embodiments are merely illustrative of the disclosure that can be embodied in various forms. In addition, each of the examples given in connection with the various embodiments is intended to be illustrative, and not restrictive. Further, the figures are not necessarily to scale, and some features may be exaggerated to show details of particular components (and any size, material and similar details shown in the figures are intended to be illustrative and not restrictive). Therefore, specific structural and functional details disclosed herein are not to be interpreted as limiting, but merely as a representative basis for teaching one skilled in the art to variously employ the disclosed embodiments.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; exemplary embodiments are provided merely to be illustrative. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

FIGS. 1-7 illustrate a helmet 10 constructed in accordance with an embodiment of the present invention. More particularly, the helmet 10 includes an outer shell 12 having an inner surface 13, an outer surface 14 and an inner cavity 16 (see FIGS. 4 and 5), as well as a longitudinal axis 18 and a latitudinal axis 19 that is substantially perpendicular to the longitudinal axis 18 (see FIG. 1). The helmet 10 includes a first sidewall 20 proximate a first end of the latitudinal axis 19, on a first side of the longitudinal axis 18, and a second sidewall 21 proximate a second end of the latitudinal axis 19, on a second side of the longitudinal axis 18 and opposite the first sidewall 20.

The outer shell 12 of the helmet 10 is fabricated from a material that is flexible but firm, so as to protect a wearer's head during an impact. Non-limiting examples of such materials include rubber, vinyl, flexible plastic and fiber mesh.

Referring now to FIGS. 2-7, the helmet 10 also includes one or more inner members 22 that are sequentially and successively arranged within the inner cavity 16 of the outer shell 12. Each inner member 22 has an outer surface 23 and an inner surface 24. At least a portion of each inner member has a generally concave shape so as to receive the crown of a user's head therein, as further discussed below. In the embodiment illustrated in FIGS. 2-7, the inner members 22 include six (6) inner members 22*a*, 22*b*, 22*c*, 22*d*, 22*e* and 22*f*, each having a smaller size relative to the next, whereby they are adapted to sequentially and successively fit into and nest within one another (see FIGS. 2, 4 and 5). More particularly, the outermost and largest inner member 22*a* is adapted to receive the next-outermost and next-largest inner member 22*b* therein, such that the inner surface 24*a* of the inner member 22*a* slideably engages the outer surface 23*b* of the inner member 22*b*. Similarly, the inner member 22*b* is adapted to receive the next-outermost and next-largest inner member 22*c* therein, such that the inner surface 24*b* of the inner member 22*b* slideably engages the outer surface 23*c* of the inner member 22*c*. The inner member 22*c* is itself adapted to receive the next-outermost and next-largest inner member 22*d* therein, such that the inner surface 24*c* of the inner member 22*c* slideably engages the outer surface 23*d* of the inner member 22*d*. The inner member 22*d* is, in turn, adapted to receive the next-outermost and next-largest inner member 22*e* therein, such that the inner surface 24*d* of the inner member 22*d* slideably engages the outer surface 23*e* of the inner member 22*e*. The inner member 22*e* is adapted to receive the innermost and smallest inner member 22*f* therein, such that the inner surface 24*e* of the inner member 22*e* slideably engages the outer surface 23*f* of the inner member 22*f* The nested inner members 22*a*, 22*b*, 22*c*, 22*d*, 22*e* and 22*f* are positioned within the inner cavity 16 of the outer shell 12, such that the outer surface 23*a* of the outermost and largest inner member 22*a* slideably engages the inner surface 13 of the outer shell. 12. When the helmet 10 is worn by a user, the inner surface 24*f* of the inner-most inner member 22*f* is in direct contact with a user's head.

Figure 2:
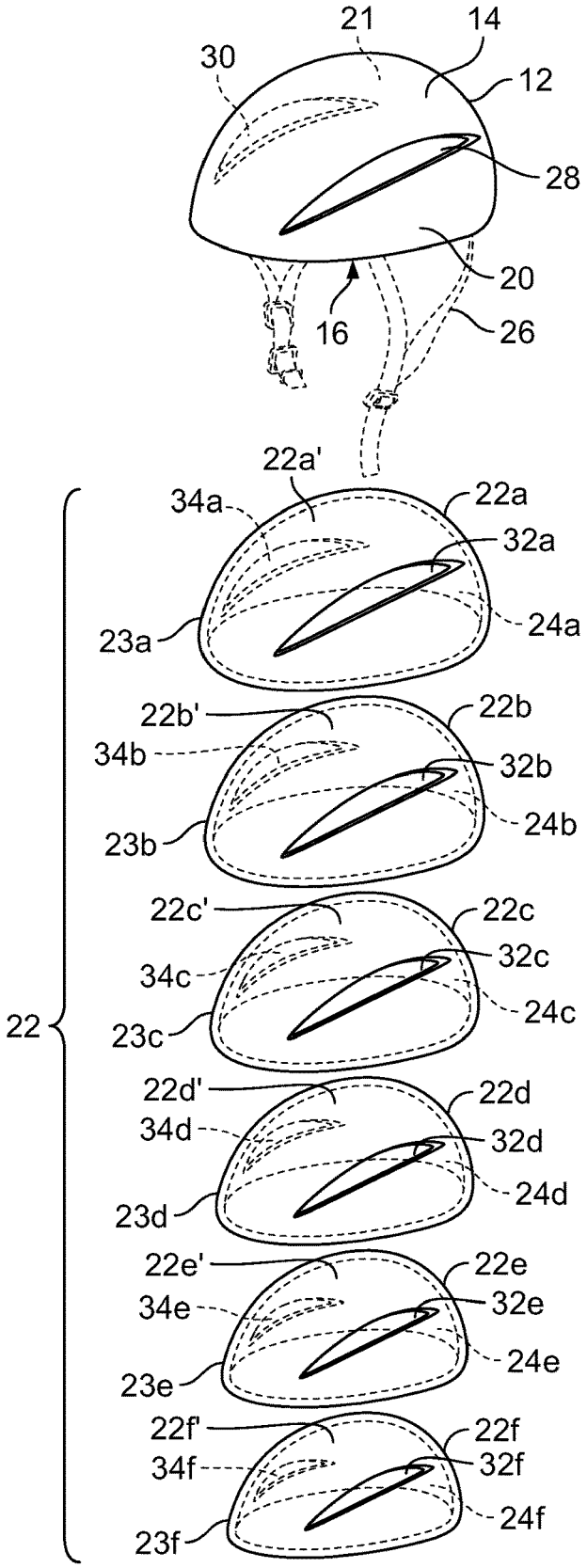
FIG. 2 is an exploded top perspective view of the helmet shown in FIG. 1.

With continued reference to FIG. 2, the inner members 22*a*, 22*b*, 22*c*, 22*d*, 22*e* and 22*f* include crown portions 22*a*', 22*b*', 22*c*', 22*d*', 22*e*' and 22*f*, respectively, each of which is curved into a generally concave shape, so as to receive the crown of a user's head therein. In various embodiments, other portions of the inner members 22 may also be curved. The inner members 22 may have a substantially hemispherical shape, a substantially dome shape, a substantially oblong shape, a substantially oval shape, or any appropriate shape that will conform to and fit the head of a user wearing the helmet 10.

Other embodiments of the present invention may include a different number of inner members 22. Non-limiting examples include two (2) inner members, three (3) inner members, four (4) inner members, five (5) inner members, seven (7) inner members, eight (8) inner members, nine (9) inner members, ten (10) inner members and twelve (12) inner members. In another embodiment, the helmet 10 may include one (1) inner member, which cooperates with the outer shell 12.

Each of the inner members 22 is fabricated from a material that is flexible and shock-absorbing. A non-limiting example of such a material is polystyrene foam (i.e., sold under the trademark STYROFOAM).

In an embodiment, each of the inner members 22 has a thickness of about 0.25 inches. Thus, in an embodiment of the helmet having four (4) inner members 22, the aggregate thickness of the inner members 22 will be about 1.0 inch. In an embodiment of the helmet having six (6) inner members 22 (as shown in FIGS. 2-5), the aggregate thickness of the inner members 22 will be about 1.5 inches. In other embodiments, each of the inner members 22 has a different thickness. Non-limiting examples include about 0.1 inches, about 0.4 inches, about 0.5 inches and about 0.75 inches.

In an embodiment, the helmet 10 is manufactured by first fabricating the outer shell 12 and inner members 22 from the materials discussed above. Once these components are fabricated, they are arranged together in a sequential and successive fashion, as discussed herein in connection with the embodiment illustrated in FIGS. 1-7. The helmet 10 is then rolled up and inserted into a package, as also discussed in detail below.

Still referring to FIGS. 2-7, the inner members 22*a*, 22*b*, 22*c*, 22*d*, 22*e* and 22*f* are arranged in a sequential and successive fashion so as to be nested within one another and slideably engage each other. In an embodiment, the inner members 22*a*, 22*b*, 22*c*, 22*d*, 22*e* and 22*f* are retained in this arrangement by a friction fit within each other. However, the inner members 22*a*, 22*b*, 22*c*, 22*d*, 22*e* and 22*f* do not include any fastening means by which they are secured to each other. In other words, the helmet 10 does not include any stitching, glue, adhesives, staples, snaps, hook and loop fasteners or other fastening means on and/or between any of the inner members 22*a*, 22*b*, 22*c*, 22*d*, 22*e* and 22*f*, for purposes to be discussed below.

Figure 6:
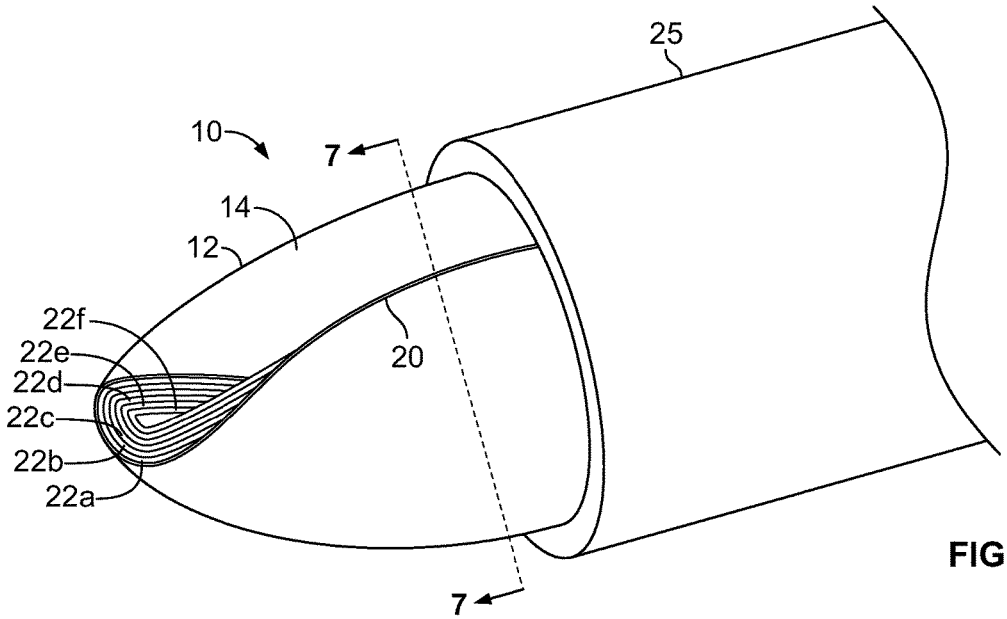
FIG. 6 is top perspective view of the helmet shown in FIG. 1 in its folded or rolled position and partially inserted in a container for same.
Figure 7:
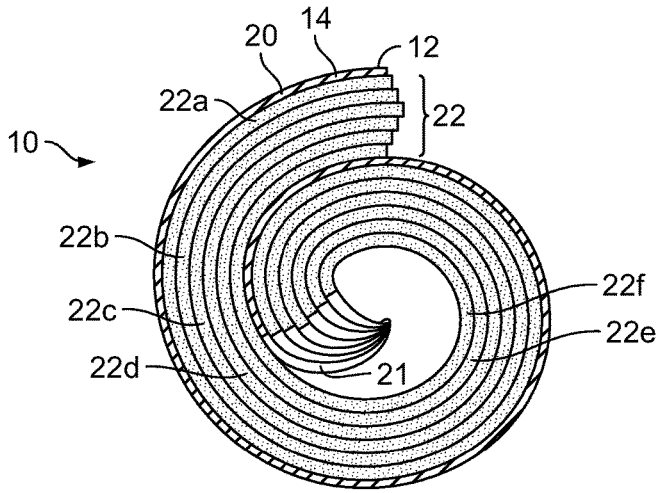
FIG. 7 is a cross-sectional view of the helmet shown in FIG. 6 taken along line 7-7, and looking in the direction of the arrows.

The operation of the helmet 10 of the present invention will now be described. FIGS. 1 and 3-6 show the helmet 10 in an open position, such as when worn by a user. After assembly of the outer shell 12 and inner member(s) 22 of the helmet 10, as discussed above, the helmet 10 is folded, or rolled, into a closed position for storage (i.e., in a tube 25) and/or transport, as shown in FIGS. 6 and 7. The rolled helmet 10 may be provided at or near locations for bicycle rentals to provide convenient access for users. Further, the helmet 10 may be designed for a single use (i.e., the helmet 10 may be disposable).

Because the flexible inner members 22*a*, 22*b*, 22*c*, 22*d*, 22*e* and 22*f* are not fixedly attached to each other at any point on their respective adjacent outer and inner surfaces 23*a*, 23*b*, 23*c*, 23*d*, 23*e*, 23*f* and 24*a*, 24*b*, 24*c*, 24*d*, 24*e*, 24*f*, they are individually moveable relative to each other, and to the outer shell 12 of the helmet 10. This structural arrangement makes the inner members 22*a*, 22*b*, 22*c*, 22*d*, 22*e* and 22*f* foldable relative to each other, and to the outer shell 12, which enables a user to fold the helmet 10 into a compact closed position in which it has a cigar-shaped configuration, and unfold the helmet 10, without permanently deforming any components of the helmet 10. Further, this structural arrangement provides a safety feature upon impact, wherein the inner members 22 slide relative to each other and to the outer shell 12, thereby dissipating the force of the impact.

In order to the fold helmet 10 from its open position to its closed position, and thereby prepare the helmet 10 for storage (i.e., in the tube 25) and/or transport, a user rolls the first sidewall 20 and second sidewall 21 towards each other, and the longitudinal axis 18 of the outer shell 12. This is achieved because the flexible inner members 22*a*, 22*b*, 22*c*, 22*d*, 22*e* and 22*f* are not attached to each other at any point along their respective adjacent surfaces, and are therefore individually foldable and slideable relative to each other. As shown in FIGS. 6 and 7, the second sidewall 21 is folded, or rolled, under the first sidewall 20, such that a portion of the outer shell 12 proximate the second sidewall 21 engages an opposed surface of the inner-most inner member 22*f*. Once the helmet 10 has been folded into its closed position, it may be inserted into a storage container, such as the tube 25 shown in FIG. 7, or another appropriate container in which the helmet 10 may be retained in its closed position and/or transported. Other types of storage containers may also be used, such as a plastic sleeve or wrapper. The storage container and helmet 10 together constitute a packaged helmet assembly.

Once folded into its closed position and inserted into a storage container, the helmet 10 may be packaged and provided to potential users for sale and/or use. For example, the packaged helmet 10 (for example in the tube 25) may be made available for sale, rental or use (e.g., in a vending machine) at sites where bicycles are rented. Once a user acquires the packaged helmet 10, he or she removes any packaging, pulls the helmet 10 out of the tube 25 and unfolds/unrolls it from its closed position to its open position. Once again, this is facilitated by the flexible inner members 22*a*, 22*b*, 22*c*, 22*d*, 22*e* and 22*f* not being attached to each other at any point along their respective adjacent surfaces, and therefore being individually slideable, and thereby foldable, relative to each other. Thereafter, the user may put the helmet 10 on his or her head, before engaging in any athletic activity in which head protection is desired. The helmet 10 may be designed for a single use (i.e., the helmet 10 may be disposed of after use).

The helmet 10 may be designed for and/or include additional components to make it useful for various athletic activities, including, but not limited to, cycling, rollerblading, ice skating, skateboarding, skiing, snowboarding, horseback riding and other equestrian activities, rock- or wall-climbing, baseball, football, hockey, lacrosse, jai alai, zip-lining, and waterskiing. For example, the embodiment shown in FIGS. 1-3 includes a strap 26 affixed proximate the first sidewall 20 and second sidewall 21.

The embodiment shown in FIGS. 1-5 also includes longitudinal openings (i.e., vents) 28 and 30 in the first sidewall 20 and second sidewall 21, respectively of the outer shell 12. The longitudinal openings 28, 30 extend between the inner surface 13 and outer surface 14 of the outer shell 12. The flexible inner members 22*a*, 22*b*, 22*c*, 22*d*, 22*e* and 22*f* shown in FIGS. 2-5 also include longitudinal openings (i.e., vents) 32*a* and 34*a*; 32*b* and 34*b*; 32*c* and 34*c*; 32*d* and 34*d*; 32*e* and 34*e*; and 32*f* and 34*f*, respectively, which extend between the respective outer and inner surfaces 23*a* and 24*a*, 23*b* and 24*b*, 23*c* and 24*c*, 23*d* and 24*d*, 23*e* and 24*e*, and 23*f* and 24*f*.

Figure 3:
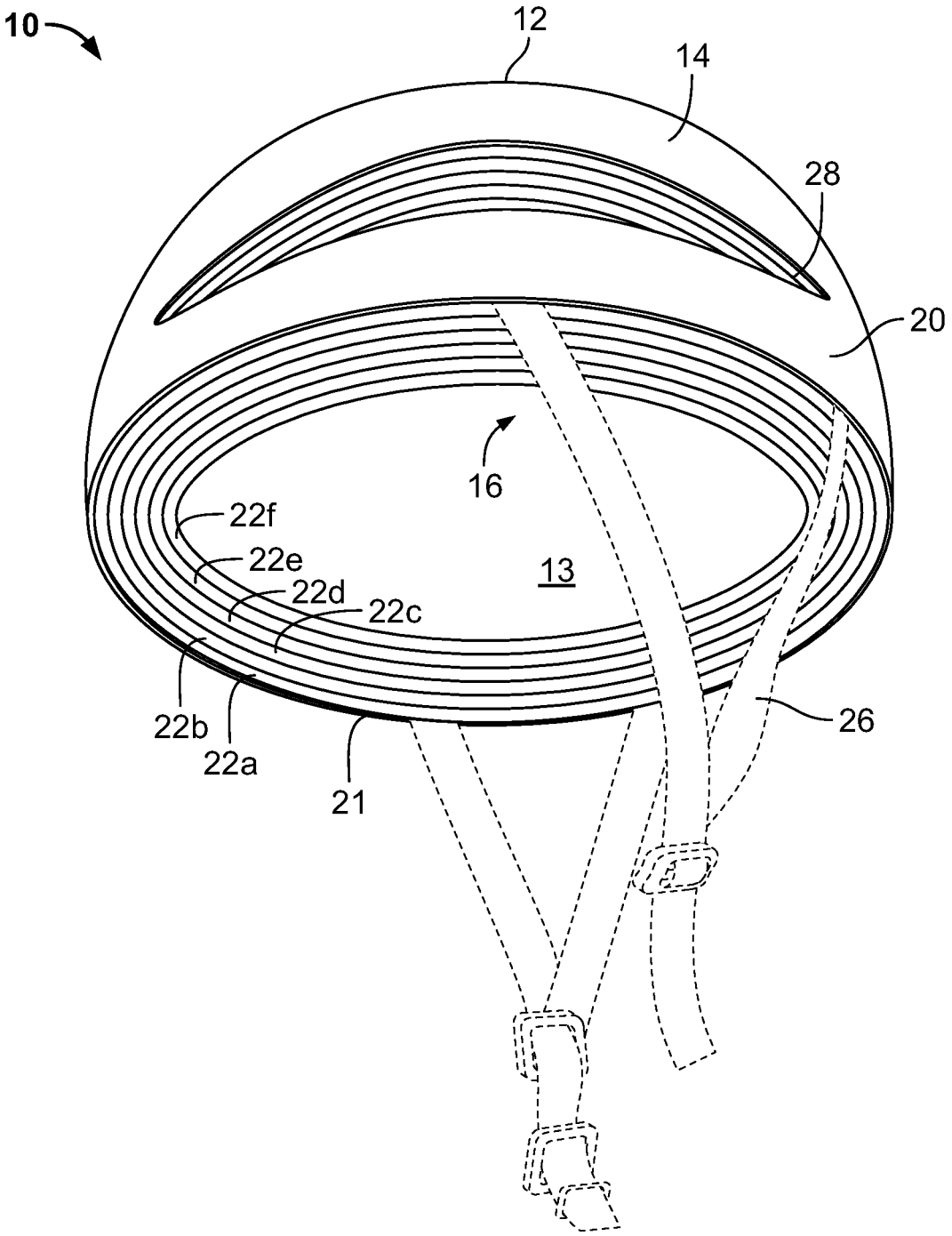
FIG. 3 is a bottom perspective view of the helmet shown in FIG. 1 in its fully open (i.e., unfolded) position.
Figure 4:
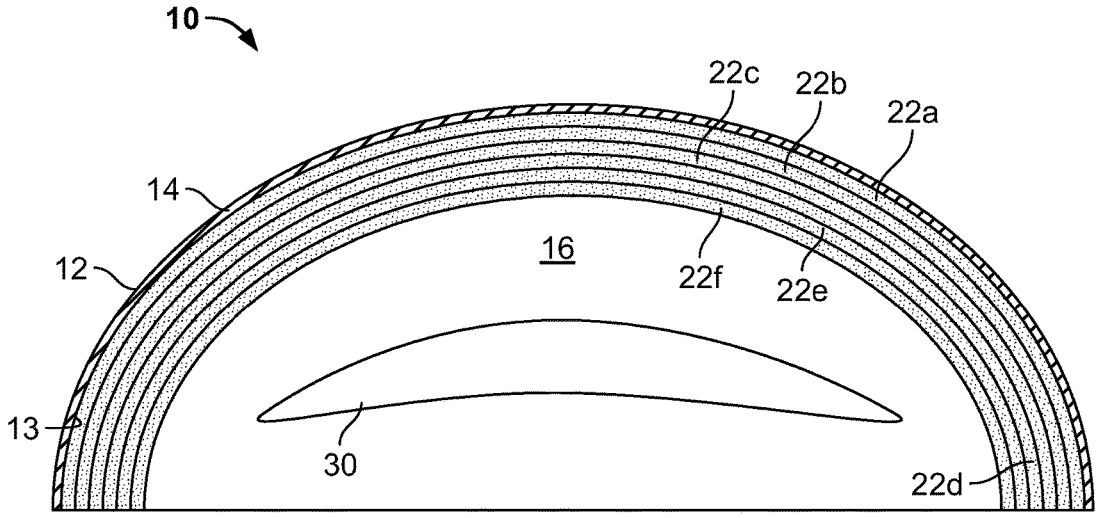
FIG. 4 is a cross-sectional view of the helmet shown in FIG. 1 taken along line 4-4, and looking in the direction of the arrows.
Figure 5:
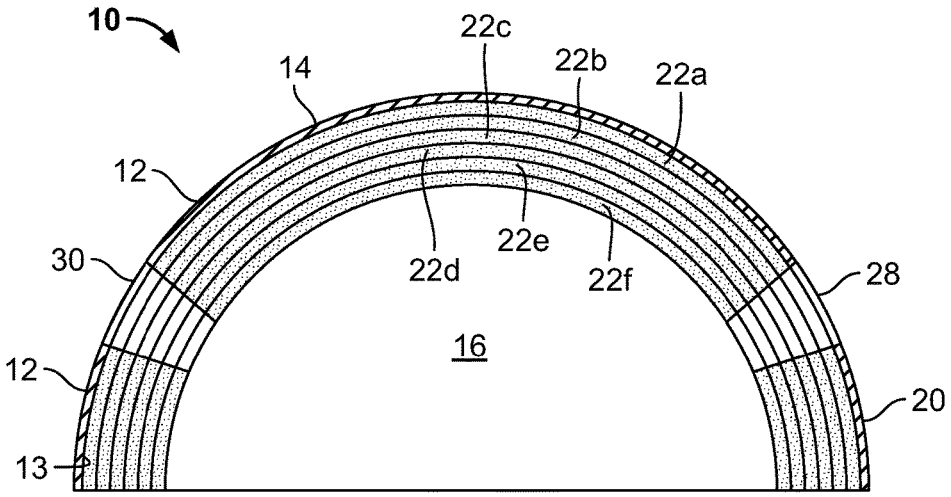
FIG. 5 is a cross-sectional view of the helmet shown in FIG. 1 taken along line 5-5, and looking in the direction of the arrows.

The longitudinal openings 32*a*, 32*b*, 32*c*, 32*d*, 32*e* and 32*f* are positioned so as to be aligned with the longitudinal opening 28 when the flexible inner members 22*a*, 22*b*, 22*c*, 22*d*, 22*e* and 22*f* are arranged within the outer shell 12 of the helmet 10, (see FIG. 3). Similarly, the longitudinal openings 34*a*, 34*b*, 34*c*, 34*d*, 34*e* and 34*f* are positioned so as to be aligned with the longitudinal opening 30 when the flexible inner members 22*a*, 22*b*, 22*c*, 22*d*, 22*e* and 22*f* are arranged within the outer shell 12.

Other embodiments of the present invention may include a different number of longitudinal openings in the outer shell 12 and/or flexible inner members 22*a*, 22*b*, 22*c*, 22*d*, 22*e* and 22*f* Non-limiting examples include one (1) longitudinal opening, three (3) longitudinal openings, four (4) longitudinal openings, five (5) longitudinal openings, or six (6) longitudinal openings. Still other embodiments may include openings having a different configuration and/or shape (e.g., non-longitudinal openings).

It should be noted that the present invention can have numerous modifications, variations and applications. For instance, the helmet 10 may include fewer or more inner members 22, as discussed above.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A foldable, multi-layer helmet adapted to be manually rollable between an open position, in which said helmet can be fitted to a user's head, and a closed position, in which said helmet can be stored in the form of a roll, said helmet comprising an outer shell made from a flexible material and adapted to form a protective, hemispherical outer layer of said helmet when said helmet is in its said open position and at least a portion of an outer layer of said roll when said helmet is in its said closed position; a first inner member made from a flexible, shock-absorbing material and adapted to be nested within said outer shell of said helmet, said first inner member forming a hemispherical inner layer of said helmet when said helmet is in its said open position and forming an inner layer of said roll when said helmet is in its said closed position, said first inner member being movably and slideably retained within said outer shell by friction between said outer shell and said first inner member, and by said friction only; and a second inner member made from a flexible, shock-absorbing material and adapted to be nested within said first inner member of said helmet, said second inner member forming another hemispherical inner layer of said helmet when said helmet is in its said open position and forming another inner layer of said roll when said helmet is in its said closed position, said second inner member being movably, and slideably retained within said first inner member by friction between said first inner member and said second inner member.

2. A foldable, multi-layer helmet according to claim 1, wherein said second inner member is movably and slideably retained within said first inner member only by said friction between said first inner member and said second inner member.

3. A foldable, multi-layer helmet according to claim 2, wherein said outer shell is made from a flexible polystyrene foam material.

4. A foldable, multi-layer helmet according to claim 3, wherein said first and second inner members are made from a flexible, rubber material.

5. A foldable, multi-layer helmet according to claim 3, wherein said first and second inner members are made from a flexible, vinyl material.

6. A foldable, multi-layer helmet according to claim 3, wherein said first and second inner members are made from a flexible, plastic material.

7. A foldable, multi-layer helmet according to claim 3, wherein said first and second inner members are made from a flexible, fiber mesh material.

8. A foldable, multi-layer helmet according to claim 3, wherein said helmet includes venting means for venting said helmet, said venting means including at least one opening extending through said helmet from said outer shell to said second inner member.

9. A foldable, multi-layer helmet according to claim 3, wherein an outer surface of said outer shell engages an inner surface of said second inner member when said helmet is rolled from its said open position to its said closed position.

10. A foldable, multi-layer helmet according to claim 1, further comprising attaching means for attaching said helmet to a user's head, said attaching means including a strap attached between opposed sides of said helmet.

11. A foldable, multi-layer helmet according to claim 1, wherein said outer shell is slideably movable relative to said first inner member in response to a force impacting said helmet when said helmet is in its said open position on a user's head, whereby said helmet functions to dissipate said force of impact.

12. A foldable, multi-layer helmet according to claim 1, wherein said helmet is adapted to assume a compact, cigar-shaped configuration in which said helmet is sufficiently compact to allow said helmet to be stored in a tubular container when said helmet is in its said closed position.

* * * * *